US006142070A

United States Patent [19]

Hoffman, Jr. et al.

[11] Patent Number: 6,142,070

[45] Date of Patent: Nov. 7, 2000

[54] INK DEFLECTOR FOR SQUEEGEE ON PRINTING MACHINE

[75] Inventors: Richard C. Hoffman, Jr., Lake Forest; Alex Iaccino, Mount Prospect; Remigiusz Kryszczuk, Chicago, all of Ill.

[73] Assignee: M&R Printing Equipment, Inc., Glen Ellyn, Ill.

[21] Appl. No.: 09/288,761

[22] Filed: Apr. 8, 1999

[51] Int. Cl.[7] ..... B41L 13/18

[52] U.S. Cl. ..... 101/123; 101/114

[58] Field of Search ..... 101/123, 126, 101/129, 114

[56] References Cited

U.S. PATENT DOCUMENTS

| | | | |
|---|---|---|---|
| 2,881,698 | 4/1959 | Graham | 101/123 |
| 3,590,736 | 7/1971 | Malek | 101/363 |
| 3,955,501 | 5/1976 | Bubley et al. | 101/123 |
| 3,988,986 | 11/1976 | Zimmer | 101/119 |
| 4,080,893 | 3/1978 | Wedell | 101/124 |
| 4,102,266 | 7/1978 | Porth | 101/124 |
| 4,121,519 | 10/1978 | Porth | 101/124 |
| 4,216,716 | 8/1980 | Zimmer | 101/120 |
| 4,389,936 | 6/1983 | Jaffa et al. | 101/123 |
| 4,509,455 | 4/1985 | Shirataki | 101/123 |
| 5,165,339 | 11/1992 | Hoffman et al. | 101/123 |
| 5,275,100 | 1/1994 | Harpold et al. | 101/335 |
| 5,383,400 | 1/1995 | Szyszko | 101/126 |
| 5,392,705 | 2/1995 | Jaffa | 101/123 |
| 5,485,781 | 1/1996 | Rovaris | 101/129 |
| 5,503,067 | 4/1996 | Jaffa | 101/123 |
| 5,595,113 | 1/1997 | Daniel et al. | 101/115 |
| 5,603,263 | 2/1997 | Dufour et al. | 101/423 |
| 5,649,479 | 7/1997 | Hoffman | 101/123 |
| 5,802,970 | 9/1998 | Tani | 101/123 |

FOREIGN PATENT DOCUMENTS

| | | |
|---|---|---|
| 63-154350 | 6/1988 | Japan . |
| 4-288235 | 10/1992 | Japan . |
| 5-200976 | 8/1993 | Japan . |
| 6-39999 | 2/1994 | Japan . |
| 8-39766 | 2/1996 | Japan . |
| 8-207243 | 8/1996 | Japan . |

*Primary Examiner*—Daniel J. Colilla
*Attorney, Agent, or Firm*—Wallenstein & Wagner, Ltd.

[57] ABSTRACT

A new ink deflector for a squeegee assembly for use in a printing operation having a screening surface is disclosed. The squeegee has a first and second surface, and a pair of opposite ends, and an attachment for holding the squeegee at a suitable operating angle relative to the screening surface. A pair of ink deflectors are provided which are each detachably positioned at an operating angle relative to the screening surface along an end of the squeegee. The operating angle of each ink deflector in the present invention is independent of the operating angle of the squeegee. Each ink deflector, which has a first surface, is designed to direct ink towards the center of the first squeegee surface. Additionally, the ink deflector has a second surface which directs ink toward the center of the second squeegee surface. The ink deflector of the present invention may also have a third surface which retains ink proximate to the second squeegee surface, and a splatter surface attached to the second surface of the ink deflector prevents ink from splattering over the deflector and onto a printed object.

38 Claims, 4 Drawing Sheets

INK DEFLECTOR FOR SQUEEGEE ON PRINTING MACHINE

TECHNICAL FIELD OF THE INVENTION

The present invention relates to the field of screen printing. Particularly, the present invention relates to a detachable scraper attachment to a screen printing squeegee.

BACKGROUND OF THE INVENTION

Printed indicia which are applied to items of clothing, such as T-shirts, sweatshirts, golf shirts, shorts, hats, and the like, as well as other cloth and paper goods, such as banners, posters, bags, flags, and the like, have become very popular over the last 20 years. Boutiques which specialize in printing fanciful and textual indicia such as slogans, college names, sports team names and logos, licensed characters, and the like, on these various media, are commonly seen in shopping malls across the country. The indicia available at these boutiques can be pre-printed on a substrate and applied with a heated press by operators at such boutiques to any of the aforementioned items purchased by a consumer, or they can be screen printed directly on the items for later purchase.

In the screen printing process, a stencil screen which has been blocked (called "masked" in the industry) to embody the desired indicia is placed over the item to be printed. Ink of one color is then flooded onto the screen (the "flood stroke") by a flood bar of conventional design. The ink may be of any type well-known in the industry for screen printing. After the ink is flooded onto the screen, the ink is squeegeed through the screen interstices onto the item (the "print stroke") leaving ink of the desired color where the interstices in the screen are unblocked. The squeegee can be of any type known in the art.

As the ink is flooded onto the screen, and during the print stroke, the ink tends to be forced to the edges of the screen between the ends of the squeegee and flood bar and the screen frame. This causes undesired ink buildup which is not utilized in the printing process and is usually wasted. To prevent this buildup, the operator must periodically scrape up the ink from the edges of the screen and place it in front of the flood bar. This is usually done while the screen printing machine is still operating, since shutting down operation can be a costly and time consuming and time consuming alternative.

The reasons for removing the ink from the edges are so the ink: (1) becomes usable and is not wasted; (2) is prevented from hardening, making cleanup especially difficult; and, (3) does not spill over the screen to ruin the object being printed upon or further dirty the screen and surrounding area. At cleanup time, the operator must clean the screen of all ink so that the screen may be reused. The ink deposits along the frame significantly increase the time required for cleanup, particularly if the ink has dried. The operator must often resort to using a spatula, putty knife, or similar object to scrape the ink from the edges of the framed screen before washing the area with solvents. Such harsh requirements can diminish the longevity of the screen.

In an attempt to automatically prevent the ink from collecting at the edges of the screen, flood bars and squeegees with integral scrapers have been developed. One such device is disclosed in U.S. Pat. No. 5,392,705 to Jaffa. The scrapers work to scrape the ink from the edges of the screen automatically while the flood bar moves along the screen during the flood stroke, and while the squeegee moves along the screen during the print stroke. The integral contoured scrapers generally work, but require the purchase of entire sets of flood bar and squeegee assemblies. This undertaking can become quite expensive since different sizes of screens and indicia are used requiring different sizes of flood bars and squeegees. Such designs also do not permit the versatility or reusability of the present invention.

U.S. Pat. No. 5,165,339 to Hoffman et al. discloses a detachable scraper attachment for a flood bar. The Hoffman et al. scraper design provides the added advantage of being detachable and capable of retrofitting existing flood bars. However, it is not capable of maintaining ink within the ink reservoir, nor does it direct ink to the center of the printing area.

Other attempts at controlling the spread of ink in a screen printing operation are disclosed in U.S. Pat. Nos.: 2,881,698 to Graham; 4,080,893 to Wedell; 4,102,266 to Porth; and 4,121,519 to Porth. The designs disclosed within these referenced patents do not solve the problems to which the present invention is specifically concerned.

SUMMARY OF THE INVENTION

In accordance with this invention, a new squeegee assembly for use in a printing operation having a screening surface is disclosed. The assembly generally comprises a squeegee, having a first and second surface, and a pair of opposite ends, and an attachment for holding the squeegee at a suitable operating angle relative to the screening surface. A pair of ink deflectors are also provided which are each detachably positioned at an operating angle relative to the screening surface along an end of the squeegee. The operating angle of each ink deflector in the present invention is independent of the operating angle of the squeegee.

It is an aspect of the present invention that the ink deflectors may be connected to an attachment for holding the squeegee. Each ink deflector, which has a first surface, is designed to direct ink towards the center of the first squeegee surface. Additionally, the ink deflector has a second surface which directs ink toward the center of the second squeegee surface. The ink deflector of the present invention may also have a third surface which retains ink proximate to the second squeegee surface.

It is still another aspect of the invention to provide a splatter surface attached to the second surface of the ink deflector.

In accordance with another aspect of the present invention, a pair of ink deflectors for use in a screen printing operation is described. The typical operation has a flood bar for applying ink to a screen, a generally parallel squeegee, having opposing ends, for pressing ink through the screen, and an ink reservoir defined between the food bar and squeegee.

In one embodiment of the present invention, the ink deflectors have a deflector body and a flange for attaching the deflector body to a position proximate an end of the squeegee. Preferably, the deflector body is comprised of a first ink deflecting surface, a second ink deflecting surface, and a retaining surface, between the two deflecting surfaces.

It is another aspect of the present invention to provide a unitary body formed from the two deflecting surfaces and the retaining surface.

It is also an aspect to provide a pair of ink deflectors which are detachable from their respective positions proximate the end of the squeegee.

DETAILED DESCRIPTION OF PREFERRED EMBODIMENT

While the invention is susceptible of embodiment in many different forms, this disclosure will describe in detail preferred embodiments of the invention with the understanding that the present disclosure is to be considered as an exemplification of the principles of the invention and is not intended to limit the broad aspects of the invention to the embodiments illustrated.

Referring generally to the appended FIGS. 1–8, the process of a screen printing operation using the present invention can be more readily understood. The disclosed ink deflector is generally referenced by the number "10" in the following disclosure and drawings. Other components are similarly and consistently numbered. While the present invention is particularly designed for automatic printing machines, such as, for example, the CHALLENGER™ and the GAUNTLET™, and their progeny, manufactured by M&R Sales and Services, Inc. of Glen Ellyn, Ill., manual systems may be capable of adaption as well.

Figure 1:
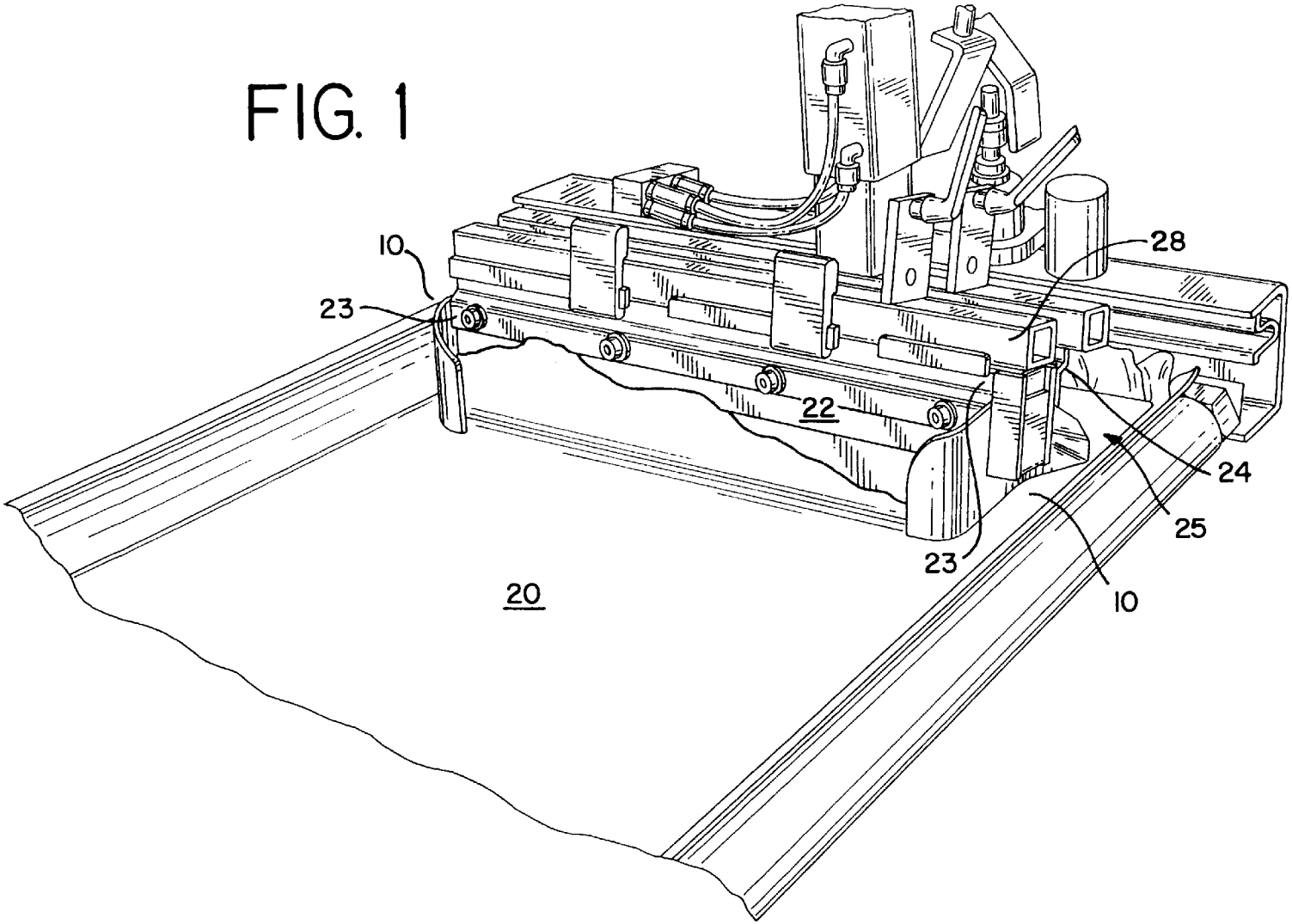
FIG. 1 illustrates a perspective view of one embodiment of the present invention attached to the squeegee assembly of an automatic screen printing machine.

The present ink deflector 10 has four distinct surfaces forming a unitary body 11. The four surfaces include a first ink deflecting surface 12, a second ink deflecting surface 13, an ink retaining surface 14, and a splatter surface 15. These surfaces act collectively to direct and retain ink within a work area of a screen 20 during printing operation, as shown in FIG. 1. The work area is defined as an area of the screen 20 within the bounds of opposite ends 23, 23 of the squeegee 22, a forward limit of the squeegee 22, and a back limit of the flood bar 24. Most preferably, the present invention directs and retains ink within an ink reservoir 25. The ink reservoir 25 is defined as the generally fixed area between the squeegee 22 and the flood bar 24.

Figure 3:
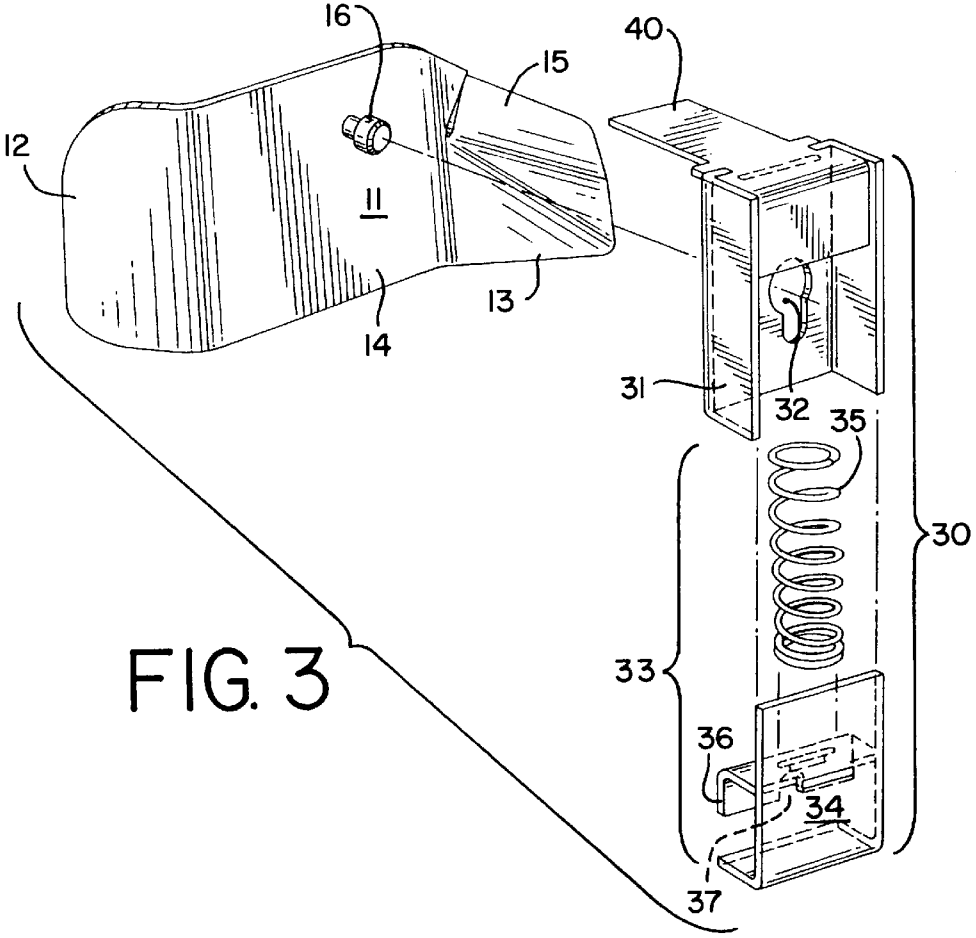
FIG. 3 is an exploded view of an embodiment of the present invention.
Figure 2:
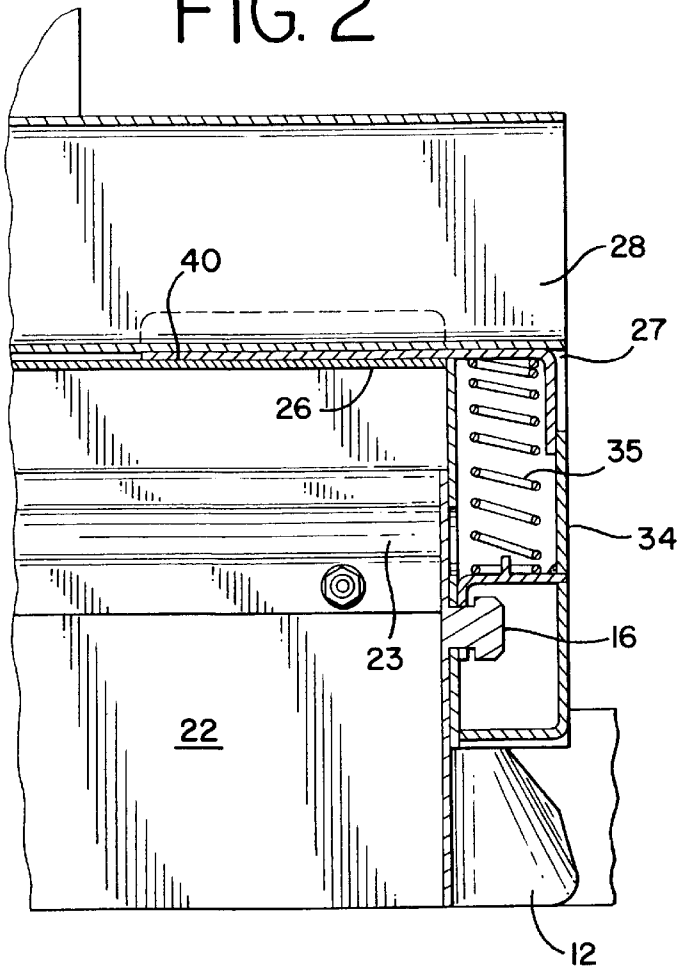
FIG. 2 is a front cross section of FIG. 1 illustrating a preferred method of attachment.

The ink deflector 10 also has a positioning mechanism 30 for connecting the unitary body 11 to a squeegee assembly, as shown in FIGS. 2 and 3. In the present embodiment, the positioning mechanism 30 is comprised of several components. A body 31 is a box-like structure of the positioning mechanism 30 having an open back portion and a narrowing locking key channel 32 within a surface opposite the open back. The unitary body 11 of the present embodiment is provided with a double-diameter knob 16 within the retaining surface 14. The position of the locking key channel 32 within the body 31, and the position of the knob 16 within the retaining surface 14 is widely variable and would be understood by those skilled in the art.

The knob 16 is inserted within the larger end of the locking key channel 32 and slid to the narrowed end, such that the larger diameter of the knob 16 is "locked in" and prevented from passing from the narrowed end. To retain this "locked in" position, the spring mechanism 33 is attached.

The spring mechanism 33 has aback plate 34, having a general "L" shape, and a collar plate 36 attached to a surface of the back plate 34 proximate the foot of the "L." The collar plate 36 extends substantially perpendicularly from a surface of the back plate 34 before turning approximately 90° toward the foot of the back plate 34. A notch 37 is centered within this turned portion of the collar plate 36, as shown in FIG. 3. The spring 35 is connected to the collar plate 36 opposite the notch 37.

Figure 4:
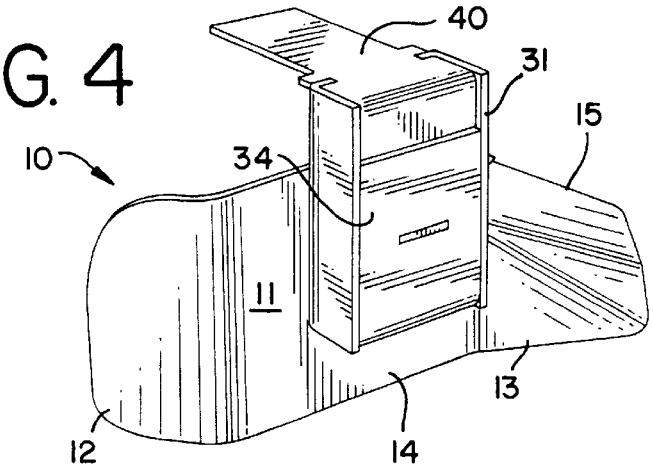
FIG. 4 is a perspective view of the embodiment of FIG. 3 shown assembled.

Upon assembly, the spring 35 is engaged within the body 31 such that the notch 37 collars the narrower diameter of the knob 16. The spring 35 biases the notch 37 (via the collar plate 36) against the knob 16, thereby maintaining the knob 16 at the narrowed end of the channel 32. The back plate 34 substantially covers the open portion of the body 31 as the spring mechanism is locked into place. Finally, extending from the body 31 is a flange 40, as shown in FIG. 4.

The previously described components are preferably formed from stainless steel, but may easily be molded from any suitable polymer material(s). The unitary body may be made from a single piece of suitable material, or several parts adhered together in any known manner. Positioning mechanism may be formed from a simple "L" bracket without the added benefit of a biased or pivoting deflecting surface.

Figure 5:
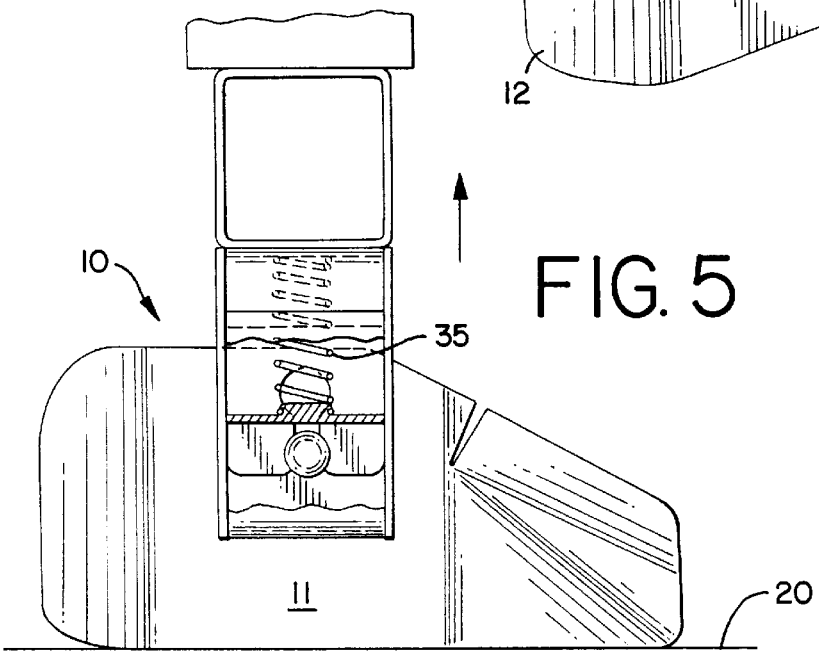
FIG. 5 is a side plan view of an embodiment of the present invention having a partial cut-away to illustrate downward actuation of the deflector.
Figure 6:
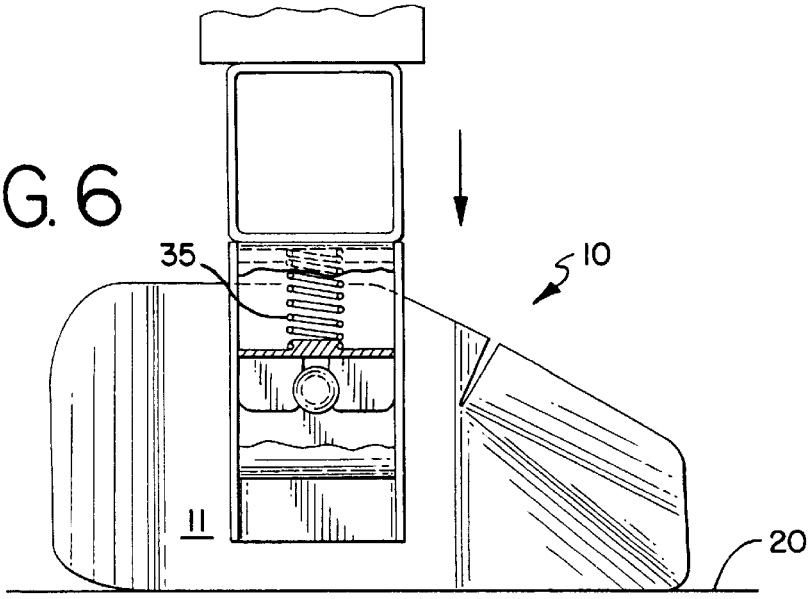
FIG. 6 is a side plan view of an embodiment of the present invention having a partial cut-away to illustrate upward actuation of the deflector.

The preferred construction, however, allows the unitary body 11 to move within the channel 32 a small distance (approximately 0.1 to 0.5 inches), thereby maintaining a positive bias of the ink directing and retaining surfaces against the screen 20, as illustrated by FIGS. 5 and 6. This feature prevents ink from passing beneath the ink deflector 10 during operation or at rest. Additionally, the protrusion 16 is rounded to allow the unitary body 11 to pivot within the channel 32. The components of deflector 10 can be readily disassembled to allow easier cleanup at the conclusion of a printing project, or to repair or replace any damaged components of the deflector.

To attach ink deflector 10 to a printing machine, referring back to FIG. 2, the flange 40 is inserted along a top edge 26 of the squeegee 22 at an opening 27. The opening 27 is typically created between the top edge 26 and an attachment arm 28 of the printing head of the machine. The end opening of the attachment arm 28 is typically rectangular, but may, of course, be of most any other shape with obvious modification to the flange 40 being necessitated. This is the preferred attachment method of the present invention. However, alternate attachment can be made to other areas of the squeegee assembly, so long as the positioning of the unitary body 11 relative to squeegee 22 is not radically altered.

The connection of the flange 40 into the opening 27 is preferably a friction fit. This can be accomplished with be accomplished with low tolerances to permit a tight fit of the flange 40 into the opening 27, or by the use of fashioning bumps (not shown) into the surface of the flange or opening, as know in the art. Other such means for effecting the connection, too numerous to mention in this application, are well known by those skilled in the art.

Figure 7:
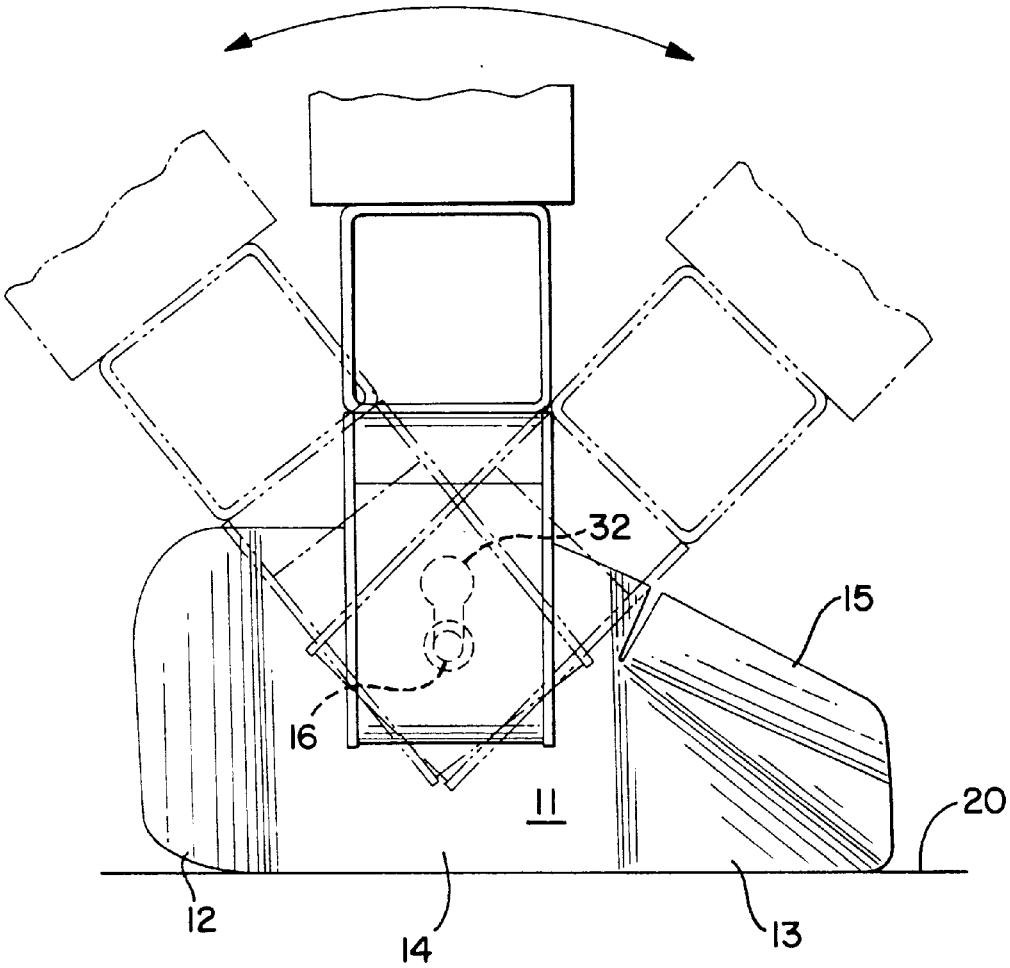
FIG. 7 is a side plan view of the embodiment shown in FIGS. 5 and 6 illustrating the pivoting of the deflector.

As the angle of squeegee is changed to suit the printing operation, the angle of the body 31 will likewise change. However, due to the pivotable configuration provided by relationship between the channel 32 and the knob 16, as illustrated in FIG. 7, contacting edges of the unitary body 11 will remain unchanged.

This pivotable configuration is helpful where the angle of the squeegee 22 relative to the screen 20 (FIG. 1) is changed either during operation, or between subsequent screen printing projects. The effective angle of the squeegee (the angle range at which printing is achieved) can be altered while the unitary body 11 maintains effective contact with the screen 20.

Referring to FIG. 1, the ink deflector 10 is preferably attached in proximity to both ends 23, 23 of the squeegee 22. The ink retaining surface 14 is brought into contact with end 23, extending in both directions beyond the opposing faces of the squeegee 22. The first ink deflecting surface 12 extends a substantial distance beyond the front or first surface of the squeegee 22, while the second ink deflecting surface 13 extends a substantial distance beyond the back or second surface (not shown) of the squeegee 22.

Ink may be placed, poured, scooped, or otherwise applied onto the screen 20 prior to beginning printing. Initially and subsequently, the ink is usually added to the process at a point either between the squeegee 22 and the flood bar 24 (called the ink reservoir 25 in the present application), or in the front of the squeegee 22.

During operation of a screen printing machine, one stroke (back to front) floods the screen and a second stroke (front to back) prints onto an objection (not shown). Flooding (evenly spreading out the ink onto a screen area) is performed by the flood bar 24 and printing (pressing the ink through the screen onto an object) is performed by the squeegee 22.

Prior to a flood stroke, the squeegee 22 is raised, via the attachment arm 28, to break contact with the screen 20. This effectively raises the deflector 10 off of the screen 20 as well. However, even if the squeegee 22 is not raised, the present invention will operate effectively. Just prior to a print stroke, the squeegee 22 is again lowered into contact with the screen 22, also engaging the ink deflector 10 of the present invention.

As the squeegee 22 is drawn across the screen 20, the second ink deflecting surface 13 directs ink outside of the squeegee width toward the ink reservoir 25. Additionally, the ink deflecting surface 13, in combination with ink retaining surface 14, holds ink within the ink reservoir 25. This is especially beneficial during downtime of the printing operation. As the printing machine is brought to a rest, the squeegee 22 and the flood bar 24 are stopped at the back of the screen 20. During this period, ink can be prevented from flowing out of the ink reservoir 25 by the ink retaining surface 14.

Continuing with the print stroke, the first ink deflecting surface 12 directs any remaining ink toward the center of the squeegee 22, where it may be used in a subsequent flood stroke. The process is repeated (a flood stroke then a print stroke) during subsequent printings.

Preferably, the present embodiment has a fourth surface, splatter surface 15, for controlling the printing ink. The splatter surface 15 extends from the top edge of second ink deflecting surface 14 in a manner somewhat parallel to screen 20. As the print stroke may be performed very fast, excess ink may splatter as it is directed back toward the ink reservoir 25. The splatter surface 15 prevents the splattering ink from getting over the side of the deflector 10 and onto the screen frame, printing machine, or printed object.

Figure 8:
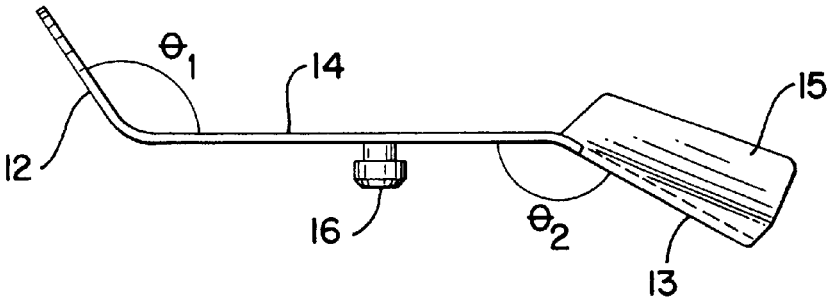
FIG. 8 is a top view of the deflecting surfaces showing the effective angles of one embodiment of the present invention.

In the present embodiment of the ink deflector 10, as shown in FIG. 8, each of the deflecting surfaces forms an effect angle with the interior wall (i.e., the wall contacting ink during operation) of ink retaining surface 14. Preferably, the effective angle measure ($\theta_1$) formed with the first ink deflecting surface is within the range of about 15° to about 90°, including any combination or subcombination of angle measure ranges within this range. The most preferred embodiment has an effective angle measure ($\theta_1$) for these two surfaces of about 45°.

The effective angle measure ($\theta_2$) formed with second ink deflecting surface is preferably within the range of about 5° to about 60°, including any combination or subcombination of angle measure ranges within this range. The most preferred embodiment has an effective angle measure ($\theta_2$) for these two surfaces of about 20°.

Splatter surface 15 also has a preferred effective angle (not shown) range measured from the plane of ink retaining surface 14. The preferred angle falls within the range of angle measures from about 5° to about 90°, including any combination and subcombination of angle measure ranges within this range. The most preferred angle measure for these two surfaces is about 25°.

Alternate embodiments may forego the use of splatter surface 15, using perhaps a slowed print stroke instead. Also, the size of the various surfaces and effective surface angles may be determined by careful consideration of various printing factors, such as screen size, printing area, print speed, ink viscosity, and the like. These factors are easily determined, and it would not be difficult for a person skilled in the art to readily determine suitable measures based on these and other factors.

While specific embodiments have been illustrated and described, numerous modifications are possible without departing from the spirit of the invention, and the scope of protection is only limited by the scope of the accompanying claims.

We claim:

1. A squeegee assembly for use in a printing operation having a screen surface, the assembly comprising:

a squeegee having a first and second surface and a pair of opposite ends;

an attachment for holding the squeegee at a suitable operating angle relative to the screen surface; and, at least one ink deflector mounted in pivotable configuration and detachably positioned at an operating angle relative to and in contact with the screen surface along at least one end of the squeegee during the printing operation, the operating angle of the ink deflector being independent of the operating angle of the squeegee.

2. The assembly of claim 1 wherein the ink deflector is connected to the attachment for holding the squeegee.

3. The assembly of claim 2 wherein the ink deflector has a first surface directing ink toward a center of the first squeegee surface.

4. The assembly of claim 3 wherein the ink deflector has a second surface directing ink toward a center of the second squeegee surface.

5. The assembly of claim 4 wherein the ink deflector has a third surface retaining ink proximate to the first squeegee surface.

6. The assembly of claim 5 wherein the first surface of the ink deflector forms an angle with an interior surface of the third surface falling within the range of from about 15° to about 90°.

7. The assembly of claim 5 wherein the second surface of the ink deflector forms an angle with an exterior surface of the third surface falling within the range of from about 5° to about 60°.

8. The assembly of claim 5 further comprising a splatter surface attached to the second surface of the ink deflector.

9. The assembly of claim 8 wherein the splatter surface forms an angle with a plane of the third surface falling within the range of from about 5° to about 90°.

10. The assembly of claim 1 wherein the ink deflector has a first surface directing ink toward a center of the first squeegee surface.

11. The assembly of claim 10 wherein the ink deflector has a second surface directing ink toward a center of the second squeegee surface.

12. The assembly of claim 1 wherein the ink deflector has a surface for directing ink toward a center of the second squeegee surface.

13. The assembly of claim 1 wherein the ink deflector has a surface for retaining ink proximate to the first squeegee surface.

14. The assembly of claim 1 wherein the at least one ink deflector comprises two ink deflectors attached to opposite ends of the squeegee.

15. An ink deflector for use in a screen printing operation having a flood bar for applying ink to a screen, a generally parallel squeegee, having opposing ends, for pressing ink through the screen, and an ink reservoir defined as an area between the flood bar and squeegee, the ink deflector comprising:

a deflector body having:
- a first ink deflecting surface;
- a second ink deflecting surface; and,
- an ink retaining surface between the two ink deflecting surfaces; and, a flange attached to the deflector body adapted to connect the deflector body to a position proximate an end of the squeegee.

16. The ink deflector of claim 15 wherein the first ink deflecting surface is effectively angled relative to the ink retaining surface to direct ink toward a front face of the squeegee during a print stroke.

17. The ink deflector of claim 16 wherein the angle measure preferably falls within the range of from about 15° to about 90°.

18. The ink deflector of claim 15 wherein the second ink deflecting surface is effectively angled relative to the ink retaining surface to direct ink toward the ink reservoir during a print stroke.

19. The ink deflector of claim 18 wherein the angle measure preferably falls within the range of from about 5° to about 60°.

20. The ink deflector of claim 15 wherein the flange comprises a positioning mechanism allowing the position of the deflector body to change relative to the flange.

21. The ink deflector of claim 20 wherein the deflector body is pivotable about a connection point to the flange.

22. The ink deflector of claim 20 wherein the deflector body is configured to move relative to the flange via a biasing component.

23. The ink deflector of claim 15 wherein the flange comprises a positioning mechanism allowing the deflector body to detach from the flange.

24. The ink deflector of claim 15 wherein the two ink deflecting surfaces and the ink retaining surface form a unitary body.

25. The ink deflector of claim 24 wherein the flange is detachable from the deflector body.

26. The ink deflector of claim 15 wherein the deflector body is detachable from a position proximate an end of the squeegee.

27. The ink deflector of claim 15 further comprising a splatter surface attached to the second ink deflecting surface.

28. The ink deflector of claim 27 wherein the splatter surface is unitary with the second ink deflecting surface.

29. The ink deflector of claim 27 wherein the splatter surface is angled relative to a plane of the ink retaining surface to direct ink toward the screen during a print stroke.

30. The ink deflector of claim 29 wherein the angle measure preferably falls within the range of from about 5° to about 90°.

31. The ink deflector of claim 15 where in the unitary deflector body is biased in a direction away from the flange.

32. The ink deflector of claim 31 wherein the deflector body is biased by a spring.

33. The ink deflector of claim 15 wherein the first ink deflecting surface extends in a direction away from the flood bar when the ink deflect or body is attached in proximity to an end of the squeegee.

34. The ink deflector of claim 15 wherein the ink deflector body is pivotable about a point of attachment to the flange.

35. A detachable ink deflector for connection to a squeegee used in a printing process, the ink deflector comprising:

a pivotable unitary deflector body having:
- a first ink deflecting surface for directing ink toward a front face of the squeegee;
- a second ink deflecting surface for directing ink toward a second face of the squeegee;
- an ink retaining surface between the two ink deflecting surfaces, wherein the first ink deflecting surface and the second ink deflecting surface each forms an angle with the ink retaining surface; and,
- a splatter surface extending from the second ink deflecting surface at an angle;

a positioning mechanism, detachably connected to the deflector body, for allowing a pivoting position of the deflector body to change relative to the squeegee; and a flange attached to the positioning mechanism and adapted to connect the positioning mechanism to a position proximate an end of the squeegee.

36. The ink deflector of claim 35 wherein the angle measure of the first ink deflecting surface preferably falls within the range of from about 15° to about 90°.

37. The ink deflector of claim 35 wherein the angle measure of the second ink deflecting surface preferably falls within the range of from about 5° to about 90°.

38. The ink deflector of claim 35 wherein the angle measure of the splatter surface preferably falls within the range of from about 5° to about 90°.

* * * * *